US010119268B2

(12) United States Patent
Lopez et al.

(10) Patent No.: US 10,119,268 B2
(45) Date of Patent: Nov. 6, 2018

(54) PROTECTIVE STRUCTURE FOR BOARD PARTITIONS

(71) Applicant: Etex Building Performance International SAS, Avignon (FR)

(72) Inventors: Pauline Lopez, Avignon (FR); Emmanuel Vial, Nimes (FR); Nicolas Costa, Vedene (FR); Crescenzo Petrone, San Felice a Cancello (IT); Gennaro Magliulo, Rome (IT)

(73) Assignee: Etex Building Performance International SAS, Avignon (FR)

( * ) Notice: Subject to any disclaimer, the term of this patent is extended or adjusted under 35 U.S.C. 154(b) by 213 days.

(21) Appl. No.: 15/105,407

(22) PCT Filed: Dec. 19, 2014

(86) PCT No.: PCT/EP2014/078829
§ 371 (c)(1),
(2) Date: Jun. 16, 2016

(87) PCT Pub. No.: WO2015/091997
PCT Pub. Date: Jun. 25, 2015

(65) Prior Publication Data

US 2016/0319539 A1 Nov. 3, 2016

(30) Foreign Application Priority Data

Dec. 20, 2013 (EP) ..... 13290326

(51) Int. Cl.
*E04B 1/98* (2006.01)
*E04B 2/82* (2006.01)
(Continued)

(52) U.S. Cl.
CPC ..... *E04B 1/98* (2013.01); *E04B 2/721* (2013.01); *E04B 2/7457* (2013.01); *E04B 2/828* (2013.01); *E04H 9/02* (2013.01); *E04H 9/021* (2013.01)

(58) Field of Classification Search
CPC ..... E04B 2/721; E04B 2/7457; E04B 2/828; E04H 9/02; E04H 9/021
See application file for complete search history.

(56) References Cited

U.S. PATENT DOCUMENTS 2,235,761 A * 3/1941 Goldsmith ..... E04L 32/825 52/241
2,315,687 A * 4/1943 Burke ..... E04C 3/005 52/241
(Continued)

FOREIGN PATENT DOCUMENTS

DE 2836126 A * 2/1980
GB 2265169 A 9/1993
(Continued)

*Primary Examiner* — Charles A Fox
*Assistant Examiner* — Charissa Ahmad
(74) *Attorney, Agent, or Firm* — Dilworth & Barrese, LLP

(57) ABSTRACT

A seismic protective structure (100) for forming part of a board partition (190) and for limiting damage to the board partition (190) when a given level of seismic stress is appearing is described. The seismic protective structure (100) comprises at least one board (101) and support elements (102, 103) for positioning the board adjacent a neighboring wall and linking the board to the remainder of the board partition wall. The seismic protective structure (100) is adapted for, when a given level of seismic stress is appearing, intentionally causing damage of the at least one board (101) thereby releasing pressure from the remainder of the board partition (190).

13 Claims, 8 Drawing Sheets

(51) Int. Cl.

| | |
|---|---|
| ***E04H 9/02*** | (2006.01) |
| ***E04B 2/74*** | (2006.01) |
| ***E04B 2/72*** | (2006.01) |

(56) References Cited

U.S. PATENT DOCUMENTS 2,796,158 A * 6/1957 Miles ..... E04B 2/76 108/152
3,332,188 A * 7/1967 Schaefer ..... E04B 2/845 52/241
3,388,521 A * 6/1968 Papalia ..... E04B 2/82 52/241
3,759,001 A * 9/1973 Judkins ..... E04B 2/7457 52/241
4,112,636 A * 9/1978 Hays ..... E04F 13/0814 52/355
4,201,020 A * 5/1980 Saunders ..... E04B 1/61 52/220.2
4,959,934 A * 10/1990 Yamada ..... E04B 1/98 52/167.7
5,040,345 A * 8/1991 Gilmour ..... E04B 2/825 52/238.1
5,163,256 A * 11/1992 Fukumoto ..... E04H 9/02 52/167.1
5,222,335 A * 6/1993 Petrecca ..... E04B 2/7457 403/230
6,210,066 B1 * 4/2001 Dent ..... E01F 9/635 248/548
6,250,042 B1 * 6/2001 Rudd ..... E04C 3/292 52/376
6,374,558 B1 * 4/2002 Surowiecki ..... E04B 2/7457 52/241
6,854,237 B2 * 2/2005 Surowiecki ..... E04L 32/7457 403/230
7,735,295 B2 * 6/2010 Surowiecki ..... E04L 32/821 52/241
7,810,290 B2 * 10/2010 Elliott ..... E04B 1/26 52/125.5
7,832,171 B2 * 11/2010 Erickson ..... E04B 2/767 52/653.1
7,966,778 B2 * 6/2011 Klein ..... E04B 2/825 52/126.3
8,061,099 B2 * 11/2011 Andrews ..... E04B 2/7457 52/243.1
8,079,188 B2 * 12/2011 Swartz ..... E04H 9/10 52/167.1
8,490,340 B2 * 7/2013 Hatzinikolas ..... E04B 1/94 52/232
8,490,341 B2 * 7/2013 Hatzinikolas ..... E04B 1/94 52/232
8,499,512 B2 * 8/2013 Pilz ..... E04B 1/24 52/235
8,511,025 B2 * 8/2013 Kawai ..... E04B 1/24 52/167.1
9,145,906 B2 * 9/2015 Schuit ..... F16B 7/0446
9,512,614 B2 * 12/2016 Klein ..... E04B 2/7411
9,834,924 B2 * 12/2017 Lopez ..... E04B 1/98
2001/0045069 A1 * 11/2001 Constantinou ..... E04H 9/02 52/167.3
2003/0196401 A1 * 10/2003 Surowiecki ..... E04L 32/7457 52/481.2
2005/0257451 A1 * 11/2005 Pryor ..... E04B 1/2403 52/167.4
2006/0032157 A1 * 2/2006 Baryla ..... E04B 2/7457 52/167.1
2006/0137293 A1 * 6/2006 Klein ..... E04B 2/7411 52/782.1
2006/0191227 A1 * 8/2006 Orszulak ..... E04B 2/767 52/481.1
2011/0179725 A1 * 7/2011 Hiriyur ..... E04B 1/2403 52/98
2011/0247281 A1 * 10/2011 Pilz ..... E04B 2/7411 52/173.1
2012/0118134 A1 * 5/2012 Swartz ..... E04H 9/10 89/36.02
2013/0118102 A1 * 5/2013 Pilz ..... E04L 31/948 52/232
2013/0174501 A1 * 7/2013 Michael ..... F16F 9/303 52/167.1
2017/0362847 A1 * 12/2017 Lopez ..... E04L 32/72

FOREIGN PATENT DOCUMENTS

GB 2489486 A * 10/2012 ..... E04B 2/7412
JP 08049328 A * 2/1996
JP 09242183 A * 9/1997
JP 11021984 A * 1/1999
JP 2005351085 A * 12/2005
JP 2011162938 A * 8/2011
WO 2009/089200 A2 7/2009
WO 2012/094756 A1 7/2012
WO 2013/057384 A1 4/2013

* cited by examiner

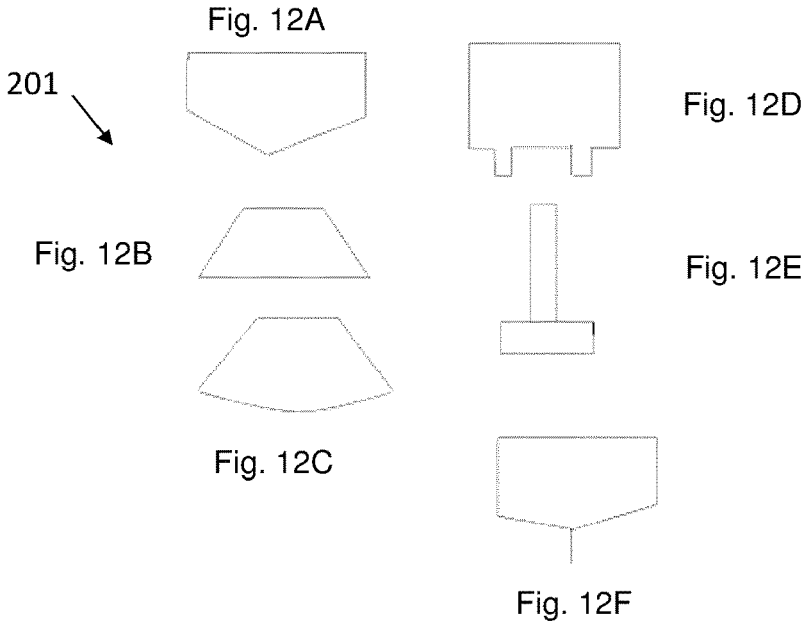
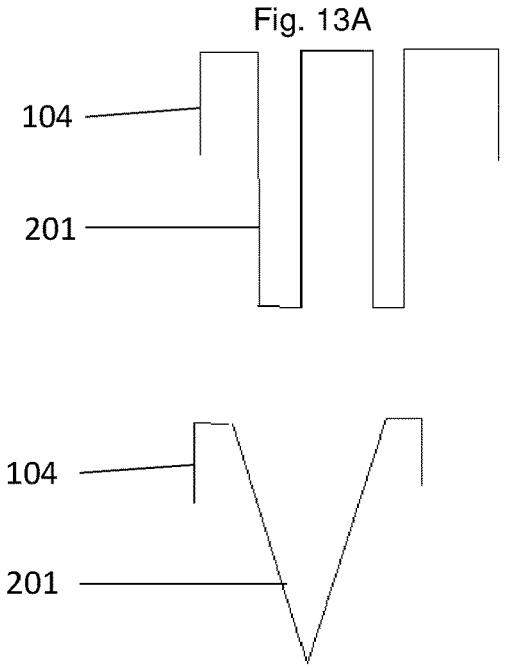
Fig. 13B

PROTECTIVE STRUCTURE FOR BOARD PARTITIONS

FIELD OF THE INVENTION

The present invention relates to the field of board partitions. More specifically it relates to a protective structure for limiting damage to board material partitions, e.g. plasterboard partitions, caused by earthquakes.

BACKGROUND OF THE INVENTION

In earthquake sensitive regions, buildings are often designed and constructed to withstand earthquake movements or to reduce the damage to their outside construction caused by such earthquake movements. Earthquake movements typically induce vertical movements and come in waves.

Whereas a lot of attention has been given to design and construction of the outside structure of buildings, also the inner walls typically get damaged during earthquakes. Inner walls typically may be constructed as plasterboard partition walls, which are built using a sub-structure made of e.g. wood or metal studs, on which plasterboards are mounted. During an earthquake these board partition walls can collapse or break due to forces on the plasterboard partition walls. More particularly, movements of the building during an earthquake typically may induce deformation of the sub-structure of the partition wall, resulting in damage to both the plasterboard wall as well as to the underlying sub-structure.

Japanese patent application JP06001520 describes one solution for reducing damage to a partition by adjusting the connection of the partition with other walls that induce stress on the partition during earthquakes. The connection is made using a linking device having an accordion-like structure allowing relative movement between the inner walls. In some particular embodiments, the linking device may be an attachment/detachment device that links the walls but that can be released when a predetermined force or larger is applied, e.g. during an earthquake. The linking device might for example be a door that is kept close using magnets and that opens when a too large force is applied.

Another solution is to construct the board partition structure freely from the remaining building structure, i.e. by leaving gaps between the partition structure and the remaining building structure. The space (deflection gap) between both typically then is filled with a flexible joint. This method works well for small earthquakes, but if the movements of the building surpass the space filled with the flexible joints, the partition structure will eventually break.

There is still room for improving board partition walls for use in earthquake sensitive regions so as to limit the damage caused by earthquakes thereto.

SUMMARY OF THE INVENTION

It is an object of the present invention to provide a system and method for limiting damage to plasterboard partition walls so as to prevent breaking or damaging of entire plasterboard partitions when stress is applied to it, e.g. during earthquakes.

It is an advantage of embodiments of the present invention that even when high levels of stress are induced by an earthquake, only a small portion of the plasterboard partition will be damaged and thus will need to be replaced or restored.

It is an advantage of embodiments of the present invention that during earthquakes a protective structure breaks before any of the other parts of the plasterboard partition are damaged due to the induced stress, resulting in releasing the remainder plasterboard partition from the high stresses induced by the earthquake. Breaking of the protective structure thus removes stress or pressure at the rest of the plasterboard partition thereby avoiding damage over the complete plasterboard partition.

It is an advantage of embodiments of the present invention that a reliable solution is provided for avoiding damage to a complete plasterboard partition during earthquakes, whereby the risk of failure of the system, e.g. during subsequent earthquakes, is reduced or avoided. It thereby is an advantage of embodiments of the present invention that after an earthquake with a given seismic level, the damaged protective structure, and only the damaged protective structure, is to be replaced, thus avoiding that mechanical parts of a re-usable seismic protective would be damaged without noticing it, causing safety issues as this may hamper proper functioning.

The above objective is accomplished by a method and device according to the present invention.

A seismic protective structure according to the invention comprises at least one board and support elements for positioning the board adjacent a neighboring wall and linking the board to the remainder of the board partition wall. The seismic protective structure is adapted for, when a given level of seismic stress is appearing, intentionally causing damage of the at least one board thereby releasing pressure from the remainder of the board partition.

According to the first aspect of the invention, the present invention relates to a seismic protective structure for forming part of a board partition and for limiting damage to the board partition when a given level of seismic stress is appearing, the seismic protective structure comprising

- at least one board,
- a first support element for connecting the at least one board thereto and for positioning the at least one board at the of the board partition adjacent an adjacent wall neighboring the board partition,
- a track element being connectable to the adjacent wall neighboring the board partition, the track element being adapted for moveably positioning the first support element therein,
- a second support element for linking the at least one board with the remainder of the board partition, wherein the seismic protective structure is adapted for, when a given level of seismic stress is appearing, intentionally causing damage of the at least one board thereby releasing stress from the remainder of the board partition.

The seismic protective structure may be adapted for, when a given level of seismic stress is appearing, intentionally causing damage of at least a first board at one side of the board partition, and of at least a second board at the other, opposite side of the board partition, thereby releasing stress from the remainder of the board partition, more particular releasing stress from the remainder of the boards at both sides of the board partition.

According to some embodiments, the acute angle between the axes of the first and second support element be less than 20°, typically less than 15°, such as less than 10°.

According to some embodiments, the first and second support element may be substantially parallel. Substantially parallel is to be understood as will the acute angle between the axes of these support elements be less than 5°.

The board may be an edge board, i.e. a board positioned at the edge of the board partition, but the invention is not limited thereto and can also relate to a system and method for breaking a board at another position in the partition board.

It is an advantage of embodiments of the present invention that the board will damage, e.g. break, at smaller levels of stress, e.g. at smaller displacement caused by seismic activity, than the remainder part of the partition structure will do thus removing pressure from the rest of the board partition thereby avoiding damage over the complete board partition and only introducing damage in the seismic protective structure.

It is an advantage of embodiments of the present invention that correct operation is guaranteed even after a number of earthquakes. In embodiments of the present invention the board breaks if the energy build up in the board exceeds a certain limit or if the displacement of the track with regard to the first vertical support element exceeds a certain distance. This prevents pressure to build up in the remainder part of the partition structure causing it to break. In this way, it can be avoided that boards such as gypsum boards or support elements in the remainder part cause damage to the environment due to failure.

The seismic protective structure may comprise a stress inducing element for introducing, when a given level of seismic stress is appearing on the board partition, additional stress on the at least one board and/or the first, optionally substantially vertical, support element for causing the seismic protective structure to damage before the rest of the board partition breaks.

It is an advantage of embodiments of the current invention that during an earthquake the stress inducing means induces a force on the protective structure which causes the protective structure to break. It is an advantage of embodiments of the current invention that during an earthquake the wedge induces a force on the first support element causing the first support element to break before parts of the rest of the board partition break.

The additional stress may be introduced directly on the board, on the first support element, or indirectly on the board via deformation or breaking of the first support element.

The stress inducing element may comprise at least one wedge shaped and positioned for, upon a given relative movement of the track element and the first support element, shifting between the first support element and the board for separating the board from the first support element. Separation of the board from the first support element may be performed by pulling through the fixing means, thus damaging but also loosening the board.

It is an advantage of embodiments of the present invention that a movement of the wedge towards the first support element and/or board induces a first force on the board, which force acts to the board surface under an angle (i.e. the angle between the force and an axis orthogonal to the board) between 50° and 0°, e.g. between 40° and 0°, e.g. between 30 and 0°, e.g. between 20 and 0°, e.g. between 10 and 0°, e.g. between 5° and 0°. It is an advantage of embodiments of the present invention that a movement of the wedge towards the first support element/board induces a first force on the board in a substantially orthogonal direction to the board and a force on the first support element opposite thereto, i.e. the angle between the force and an axis orthogonal to the board is between 5° and 0°. It is an advantage of embodiments of the present invention that the first and second force efficiently disconnect the board from the first support element. In embodiments of the present invention a movement of the wedge in the direction of the first support element thus causes two opposite forces for separating the gypsum board and the support element.

In some embodiments, the wedge may have a triangular cross-section, with the first side of the cross-section mountable against a neighboring wall, the second side of the cross-section mountable against the track element, such that when moving towards the first support element, the corner between the second and third side of the wedge moves between the board and the first support element.

In some embodiments, the wedge may have a triangular cross-section, with the first side of the cross-section mountable on the inside of the track element towards the neighboring wall and the second side of the cross-section mountable against the inside of the track element, such that when moving towards the first support element, the corner between the second and third side of the wedge moves between the track and the first support element.

It is an advantage of embodiments of the present invention that displacements of the wedge caused by an earthquake are inducing a force on the board in another direction as the moving direction.

It is an advantage of embodiments of the current invention that the wedge can be adapted depending on the environmental requirements such that it fits perfectly between the wall and the track and that a corner is in between the board and the first support element.

The track element may be adapted in shape with a protrusion for spacing the gypsum board and the first support element with a gap for, upon a given relative movement of the track element and the first support element, introducing the wedge between the board and the first support element.

The first support element may comprise a weak portion for breaking of the first support element upon a given level of seismic stress is appearing.

It is an advantage of embodiments of the present invention that the first support element breaks instead of the rest of the board partition wall. Breaking of the first support element releases the pressure from the rest of the board partition. The first support element may thus be weaker than further, optionally substantially vertical, support elements. The weak portion may be obtained by a perforation introduced in the element, a particular profile introduced in the element, use of another material, etc.

The first support element may comprise two, optionally substantially symmetric, sub-elements glued to each other, wherein the weak portion corresponds with the gluing zone where the sub-elements are glued to each other. The term substantially symmetric means within the normally applicable tolerances.

The stress inducing means may comprise a stress inducing element mountable or mounted to the track for inducing a stress on the first support element, when the track is moving relatively with respect to the first support element under influence of an earthquake. It is an advantage of embodiments of the current invention that the first support element breaks instead of the rest of the board partition wall.

The first support element may comprise a pressure inducing means deforming under influence of a given level of seismic stress on the partition board wall such that said deformed pressure inducing means induces a pressure on the at least one board for breaking the board.

At least two of the pressure inducing means, the first support element and the track element may be integrated in a single piece.

It is an advantage of embodiments of the current invention that it allows easy placement. In embodiments of the present invention the pressure inducing means, the first support element and the track element may be reduced to one piece. This simplifies the placements and renders the placement less error prone. The latter may assist in correct functional behavior during an earthquake.

The board may be made of the same material as the boards of the board partition. In embodiments where the early failure of the protective structure is caused by an additional stress inducing means, the same, optionally gypsum, boards can be used for the protective structure as those that are used for the rest of the partition wall. It is an advantage of embodiments of the current invention that these materials are fire resistance. The complete board partition including the protective structure is therefore fire resistant.

The at least one board may comprise a weaker portion such that, when a given level of seismic stress is appearing on the board partition, optionally a gypsum board partition, the board will break at the weaker portion.

It is an advantage of embodiments of the current invention that the protective structure can be based merely on the use of a special board comprising a weaker part. Such a weaker part may for example be a groove in the board or a portion of the board being thinner than the rest of the board. It is an advantage of embodiments of the present invention that such special boards are easily manufacturable. The weaker part may be obtained by pre-cutting the board, by other types of post-processing or by introducing it during the manufacturing process of the board.

The board, optionally a gypsum board, may be connected through a rotating suspension with the second support element or a further board of the board partition.

It is an advantage of embodiments of the present invention that the board doesn't fall on the ground after being disconnected from the first support element or after breaking of the first support element.

The present invention also relates, according to a second aspect, to a board partition comprising a seismic protective structure as described above.

According to some embodiments of the invention, the first and the second support element may be substantially vertically mounted. Substantially vertically means vertical plus or minus an angle of 5°.

The present invention furthermore relates, according to a third aspect, to a kit of parts for constructing a seismic protective structure as described above, the kit of parts comprising one or more of a track element, a first support element and at least one board, Wherein the kit of parts comprises furthermore a stress inducing means for, when mounted in the seismic protective structure, introducing, when a given level of seismic stress is appearing on the board partition, additional stress on the at least one board and/or on the first, optionally substantially vertical, support element for causing the seismic protective structure to damage before the rest of the board partition wall breaks, and/or wherein the at least one board comprises a weaker portion such that, when a given level of seismic stress is appearing on the board partition, the board will break at the weaker portion.

The present invention also relates, according to a fourth aspect, to a method for protecting a board partition against a given level of seismic stress, the method comprising using a seismic protective structure in the board partition such that, when a given level of seismic stress is appearing, damage is intentionally caused to at least one board of the seismic protective structure thereby releasing pressure from the remainder of the board partition.

The present invention furthermore relates, according to a fifth aspect, to a method for restoring a board partition after an earthquake, the board partition comprising a seismic protective structure as described above, the method comprising replacing one or more of the board and a first support element for restoring the board partition.

This seismic protective structure functions so to say as a mechanical fuse system. The fuse system advantageously is positioned at one or both of the vertical sides of a board partition.

It is an advantage of embodiments of the present invention that the mechanical fuse as described above is not only suitable for gypsum plate material, but also is suitable for other type of plate material.

It is an advantage of embodiments of the present invention that the mechanical fuse does not only work with one, but also with multiple plates being mounted to one or each side of the wall.

Particular and preferred aspects of the invention are set out in the accompanying independent and dependent claims. Features from the dependent claims may be combined with features of the independent claims and with features of other dependent claims as appropriate and not merely as explicitly set out in the claims.

These and other aspects of the invention will be apparent from and elucidated with reference to the embodiment(s) described hereinafter.

BRIEF DESCRIPTION OF THE DRAWINGS

FIGS. 12A-12F each illustrate a schematic top view of possible embodiments of a wedge in accordance with the current invention.

FIGS. 13A and 13B each illustrate a schematic top view of art integrated track and wedge in accordance with embodiments of the current invention.

Figure 1:
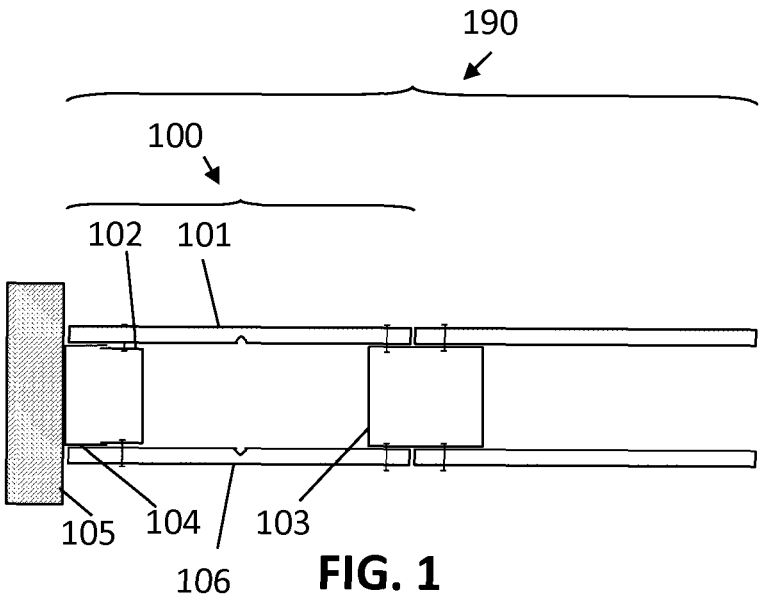
FIG. 1 provides a schematic top view of a protective structure in between a wall and the rest of the board partition in accordance with a first embodiment of the present invention.

The drawings are only schematic and are non-limiting. In the drawings, the size of some of the elements may be exaggerated and not drawn on scale for illustrative purposes.

Any reference signs in the claims shall not be construed as limiting the scope. In the different drawings, the same reference signs refer to the same or analogous elements.

DETAILED DESCRIPTION OF ILLUSTRATIVE EMBODIMENTS

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not correspond to actual reductions to practice of the invention.

Furthermore, the terms first, second and the like in the description and in the claims, are used for distinguishing between similar elements and not necessarily for describing a sequence, either temporally, spatially, in ranking or in any other manner. It is to be understood that the terms so used are interchangeable under appropriate circumstances and that the embodiments of the invention described herein are capable of operation in other sequences than described or illustrated herein.

Moreover, the terms top, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

In the description provided herein, numerous specific details are set forth. However, it is understood that embodiments of the invention may be practiced without these specific details. In other instances, well-known methods, structures and techniques have not been shown in detail in order not to obscure an understanding of this description.

Where in embodiments of the present invention reference is made to damaging of a board, reference is made to breaking of the board, to pulling through of the fixing means through the board, etc.

Where in embodiments of the present invention reference is made to "a board partition", reference is made to a wall made by placing boards on an underlying structure. Such an underlying structure may be based on wood, on metal studs or any other sufficiently strong structural supporting elements.

Where in embodiments of the present invention reference is made to a "seismic protective structure", reference is made to part of the board partition which protects the rest of the board partition from breaking because of an earthquake.

Where in embodiments of the present invention reference is made to "the rest of the board partition" reference is made to all components of the board partition except for the components of the seismic protective structure.

In a first aspect, the present invention relates to a system suitable for forming part of a board partition and for limiting the damage to a board partition in a building, when a given level of seismic activity occurs. In embodiments of the present invention this system is referred to as "the seismic protective structure" or "the mechanical fuse". The seismic protective structure thus is the part of the board partition 190 that breaks because of seismic movements of the building.

In the first aspect, the present invention relates to a seismic protective structure for forming part of a board partition and for limiting damage to the board partition when a given level of seismic activity and thus seismic stress on the wall is appearing. The seismic protective structure according to embodiments comprises at least one board, a first, optionally substantially vertical, support element for connecting the at least one board thereto and for positioning the at least one gypsum board at the of the board partition adjacent an adjacent wall neighboring the board partition. The system also comprises a track element being connectable to the adjacent wall neighboring the board partition. The track element thereby is adapted for moveably positioning or guiding the first, optionally substantially vertical, support element therein. The first support element and the track element thus are not fixedly connected to each other and can move with respect to each other. According to embodiments, the present invention also comprises a second, optionally substantially vertical, support element for linking the at least one gypsum board with the remainder of the board partition wall. The seismic protective structure further is adapted for, when a given level of seismic stress is appearing, intentionally causing damage of the at least one gypsum board thereby releasing stress from the remainder of the board partition.

Although in the below embodiments, the invention is described with reference to gypsum boards and gypsum board partitions, the present invention is not limited thereto and other types of board material and board partitions are also envisaged.

By way of illustration, embodiments of the present invention not limited thereby, standard and optional details of the system and of standard and optional components thereof will further be described with reference to a number of drawings.

The protective structure can be obtained in a number of different embodiments, all resulting in the fact that the seismic protective structure 100 will break first, thus releasing the stress or pressure on the rest of the board partition wall.

In a first set of embodiments, the damage to the at least one gypsum board is caused by providing a weaker portion in the gypsum board. An example of such an embodiment is shown in FIG. 1. In FIG. 1 a seismic protective structure 100 being part of a gypsum board partition 190 is shown. One gypsum board 101 or, as shown in FIG. 1, a gypsum board 101, 106 at each side of the wall is fixed to a first support element 102 which is guided by or in a track element 104 which is connected to a neighbouring, exterior, structural wall 105. The width of the gypsum board used may for example be between 10 cm and 50 cm. The support element 102, further also referred to as stud 102, and typically is substantially vertically oriented, with reference to the floor level. In embodiments of the present invention the seismic protective structure 100 is connected with the rest of the gypsum board partition 109 by means of the second support element 103, also referred to as stud 103. When the structural wall 105 moves because of an earthquake, the seismic protective structure 100 will break as first. t is an advantage of embodiments of the present invention that the rest of the board partition is prevented from being damaged by the breaking of the protective structure 100, thus releasing the pressure or stress from the rest of the board partition wall.

According to the present embodiments, the at least one gypsum board 101, 106 comprises a weak portion. Such a weak portion can be obtained in a plurality of ways, e.g. by cutting in or profiling the gypsum board 101, 106, e.g. providing locally a smaller thickness of the gypsum board 101, 106. Another possibility is to use weaker board material. It is an advantage of embodiments of the current invention that the protective board 101, 106 breaks before the non-protective part of the board partition breaks.

According to embodiments of the present invention, the track element 104 and the first support element 102 are positioned with respect to each other such that there can be an initial movement with respect to each other before stress is built up in the seismic protective structure. The latter results in the fact that damage can be avoided on the board partition and the seismic protective structure when only small seismic activity—i.e. low level earthquakes—is present. The allowed movement before stress is built up may be in the range of 1 cm.

In another set of embodiments, a stress inducing means is provided such that intentionally additional stress is provided in the seismic protective structure, resulting in intentionally damaging of the protective structure. This can be implemented in a variety of ways.

In some embodiments of the present invention the stress inducing means 201 is implemented as a wedge 201 provided in the seismic protective structure 100. The wedge 201 is constructed such that, when the track element 104 and the support element 102 move with respect to each other due to seismic activity, the wedge induces a force or stress on the protective structure 100, causing the protective structure 100 to break before the rest of the board partition breaks.

In some embodiments, the wedge 201 may be mounted on the track. The wedge may be positioned in such a way that movement of the wedge 201 occurs between the protective board 101, 106 and the first stud 102 forces the protective board 101, 106 to be detached 15 from the first stud 102. Detaching may for example be caused by the fixings (e.g. screws, glue) fixing the protective board 101, 106 to the first stud 102 being broken (e.g. pulled through the protective board 101, 106 in case of screws) by the force induced by the wedge 201. In embodiments of the present invention the wedge 201 may have a triangular cross-section, with the first side mountable against the structural wall 105, the second side mountable against the track 104, such that when moving, the corner between the second and third side moves between the protective board 101, 106 and the first stud 102. The angle between the second and third side can vary between 0° and 90° preferably between 45° and 90°.

Figure 2:
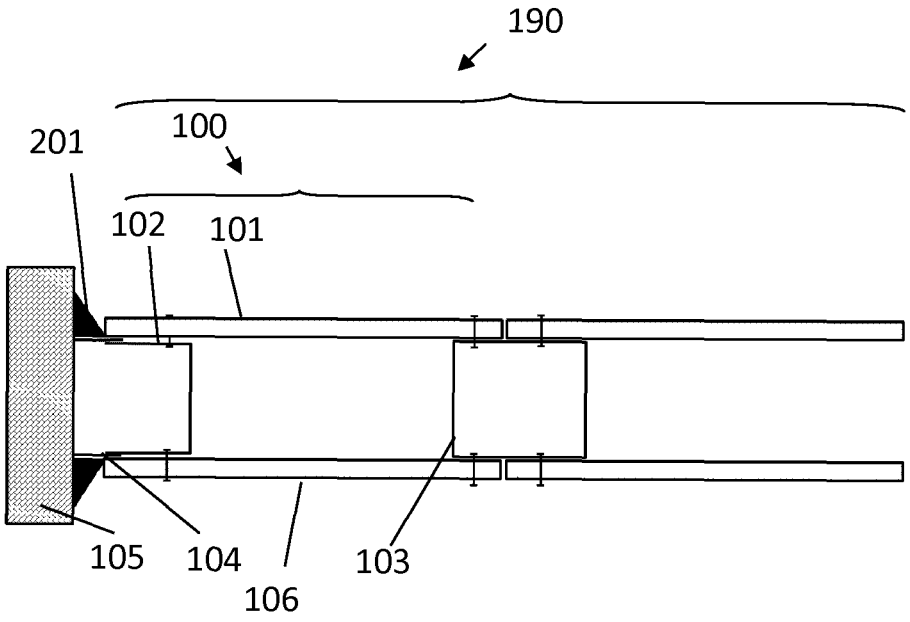
FIG. 2 respectively FIG. 3 provides a schematic top respectively front view of a protective structure in between a wall and the rest of the board partition in accordance with a wedge based embodiment of the present invention.
Figure 3:
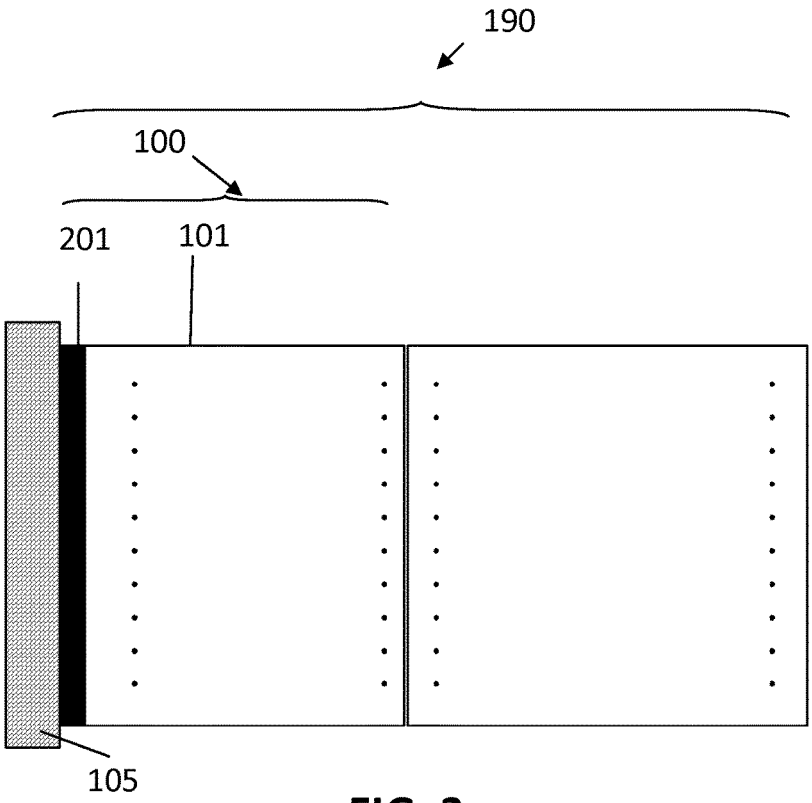
Figure 4:
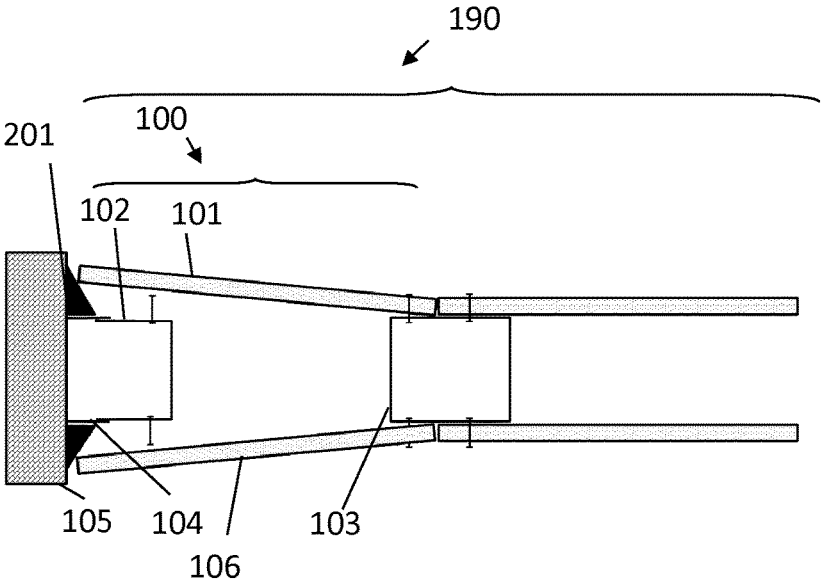
FIG. 4 provides a schematic top view of a protective structure in between a wall and the rest of the board partition after being damaged by an earthquake in accordance with embodiments of the current invention.
Figure 5:
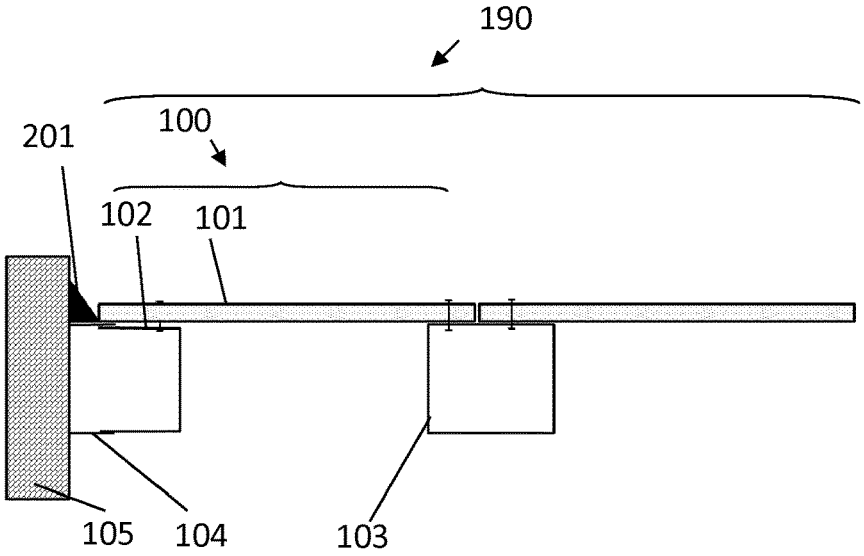
FIG. 5 provides a schematic top view of a protective structure with boards only on one side of the board partition in accordance with embodiments of the current invention.

In some embodiments of the current invention the cross-section of the wedge 201 has a shape, such that when moving between the protective board 101, 106 and the first stud 102, it forces the protective board 101, 106 and the first stud 102 to be separated from each other. This can be a triangular form as described above but also any other suitable cross-section can be used. An exemplary embodiment of such a wedge is illustrated in FIG. 2, FIG. 3, FIG. 4 and FIG. 5. FIG. 2, FIG, 3 and FIG. 4 illustrate a part of a gypsum board wall having gypsum boards at both sides, whereas FIG. 5 illustrates a gypsum board wall with gypsum boards at only one side. FIG. 2 and FIG. 3 illustrate a top view respectively a front view of the seismic protective structure. FIG. 4 how the wedge 201 breaks the protective board 101, 106 apart from the first stud 102.

It is an advantage of embodiments of the current invention that the gap created by breaking of the protective structure 100, protects the rest of the board partition from breaking. After breaking of the protective structure 100, no risk of buckling studs and falling of boards in the rest of the board partition exists anymore. It is an advantage of embodiments of the current invention that only the protective structure 100 needs to be replaced in case of breaking after an earthquake.

In FIG. 4 a first stud 102 and second stud 103, a track element 104 for guiding the first stud 102 and a wedge 201 connected to the structural wall 105 on a first side and connected to the track 104 on a second side can be seen. The wedge corner between the second and third side will move between the first 102 stud and the protective board 101, 106 in case of an earthquake. In case of severe earthquakes it will detach and damage the gypsum board 101, 106 from the first stud 102 thereby releasing pressure from the rest of the board partition wall. When the gypsum board 101, 106 disconnects from the first stud 102, the first stud can freely move without applying a force on the second stud 103.

FIG. 5 illustrates embodiments of the present invention wherein only one side of the gypsum board partition is mounted with gypsum boards. In the figures a structural wall 105, a track 104, a wedge 201, a first stud 102, a single protective board 101 and a pull through screw are shown. When the structural wall 105 starts moving because of an earthquake, the wedge 201 will push the board away from the stud 102 thereby pulling the pull through screws through the protective board 101.

Figure 6:
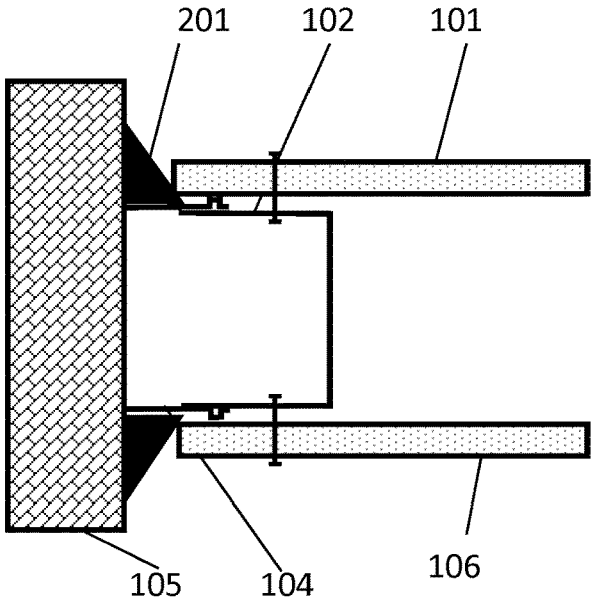
FIG. 6 provides a schematic top view of another protective structure in accordance with embodiments of the current invention.
Figure 7:
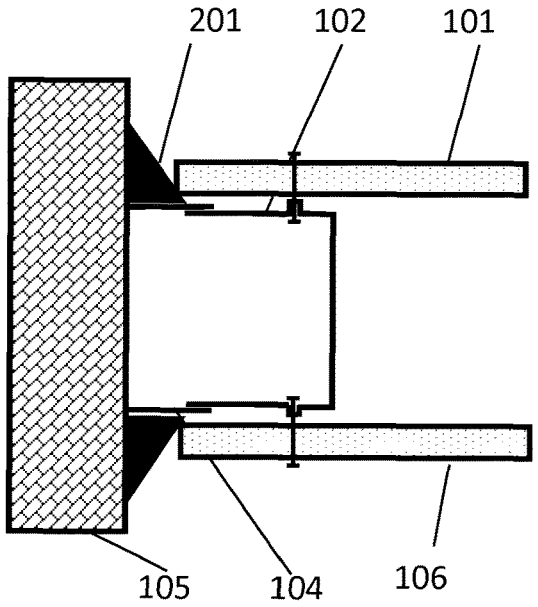
FIG. 7 provides a schematic top view of another protective structure in accordance with embodiments of the current invention.

In the embodiment illustrated in FIG. 6, the track element 104 is constructed such that when the protective board 101, 106 is mounted against the first stud 102, still place is present between the protective board 101, 106 and the first stud 102 for the wedge 201 to move in between them. Therefore a protrusion is introduced on the track element 104. The latter can be by providing a supplemental element or by specifically shaping the track element upfront. In the embodiment illustrated in FIG. 7, the protrusion is introduced on the first support element 102. It serves the same functionality as the protrusion on the track element, namely to separate the first stud 102 and the protective board 101, 106 such that the wedge 201 can easily initiate moving in between them.

Figure 8:
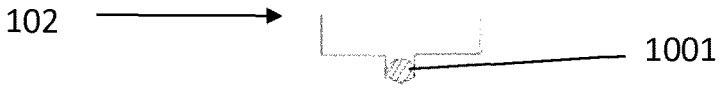
FIG. 8 provides a schematic top view of a first support element with weak zone in accordance with one embodiment of the current invention.
Figure 9:
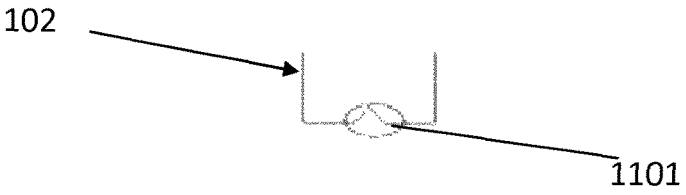
FIG. 9 provides a schematic top view of a first support element with weak zone in accordance with another embodiment of the current invention.

In some embodiments, the first support element 102 is a support element which is made weaker than the support elements used in the remainder part of the gypsum wall. Two examples of how the support element can be provided with a weaker portion are shown in FIG. 8 and FIG. 9. In one embodiment the first stud 102 is a stud with two symmetric separable parts connected by glue 1001, the zone where the parts are glued being the weaker zone. In another embodiment, the first stud 102 is made weaker by introducing a weak point 1101 in the stud that breaks at a specific force level. In embodiments of the current invention the stud may be made of metal, e.g. steel, although embodiments are not limited thereto. In embodiments of the current invention the weak point 1101 is, a hole or a plurality of holes, or a perforation, or is created by using another type of material than the stud material.

Figure 10:
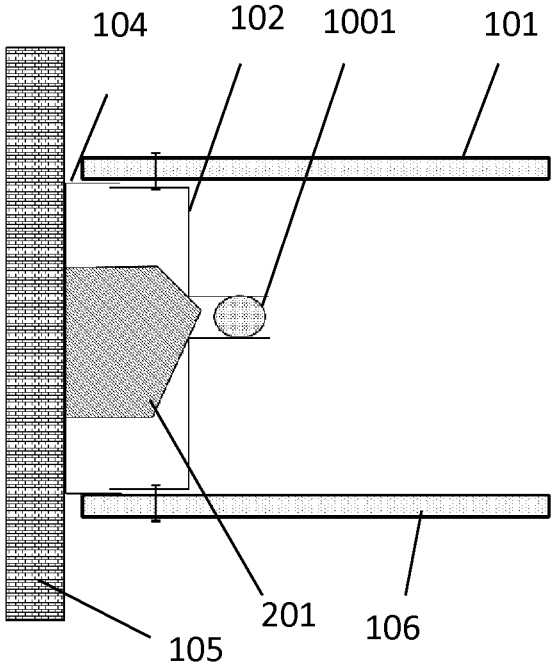
FIG. 10 provides a schematic top view of a protective structure in accordance with embodiments of the current invention.
Figure 11:
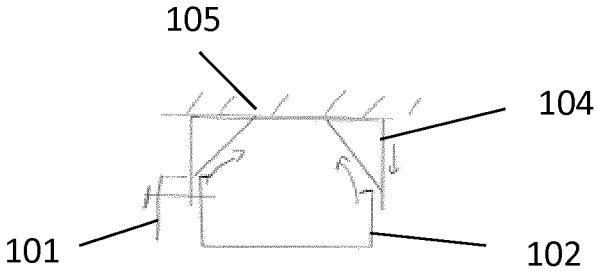
FIG. 11 provides a schematic top view of a first stud and wedge in accordance with embodiments of the current invention.

In some embodiments of the present invention, especially when a first support element is used that comprises a weak portion, the seismic protective structure comprises a wedge 201 which is mounted inside the track 104. During an earthquake of a sufficient level, the wedge 201 mounted inside the track pushes against the first stud 102 thereby breaking the first stud 102 and as such separating the two parts of the first stud 102. After breaking the first stud 102, the force on the second stud 103 and the rest of the board partition is released. The pressure on the first support element 102 may additionally or alternatively also induce additional stress in the gypsum board, thus resulting in the breaking of the gypsum board. An exemplary embodiment is illustrated in FIG. 10, wherein a wedge shaped element in the track element 104 is provided that provides a pressure on the first support element 102 such that it will be separated in two parts as the glueing zone will break. In another exemplary embodiment, illustrated in FIG. 11, the wedge 201 is inside the track 104 and forces the sides of the first stud 102 away from the protective board 101 when the wedge 201 is moving under influence of an earthquake. The first support element 102 is deformed thus causing damaging of the gypsum board. A high level earthquake will cause first stud 102 to be completely detached from the first protective board 101. FIG. 11 illustrates an exemplary embodiment of the current invention whereby the track 104 has a wedge 201 with a triangular cross-section. When mounted, the first stud 102 is on the inside of the track 104 and the protective board 101 is on the outside of the track. When the track 104 is moving with regard to the first stud 102 and the protective board 101, the triangular shape of the wedge 201 will push the protective board 101 away from the first stud. If the displacement between the track 104 and the protective stud 102 is high enough the protective board 101 will be completely separated from the first stud 102. The cross-section of the wedge 201 not necessarily needs to be triangular. Any other shape of the cross-section enabling the wedge 201 to separate the first stud from the protective board is possible as an embodiment of the current invention.

FIG. 12 shows cross-sections of wedges 201 (*a-f*) that can be used in some embodiments according to the present invention. These wedges 201 can for example be mounted inside the track 104, against the structural wall 105, and push, during an earthquake, against the first stud 102 breaking it at a certain force or deforming it such that damage to the gypsum board is caused. It is an advantage of embodiments of the current invention that this force is below the force required to break the rest of the board partition wall, thus preventing the rest of the gypsum board partition to be damaged. As indicated above, the first stud 102 may be made weaker than the second stud 103.

FIG. 13 illustrates cross-sections of an integrated track 104 and wedge 201 according to some embodiments of the present invention. The track 104, being a guidance for the first stud 102, has a form such that during an earthquake it exercises a pressure on the first stud 102, causing the first stud 102 to break if the displacement of the track 104 with regard to the first stud 102 is high enough. The wedge 201 may have a triangular form (FIG. 13*b*) or may exist of several pressure points (FIG. 13*a*) or may have another form for efficiently breaking the first stud 102.

Figure 14:
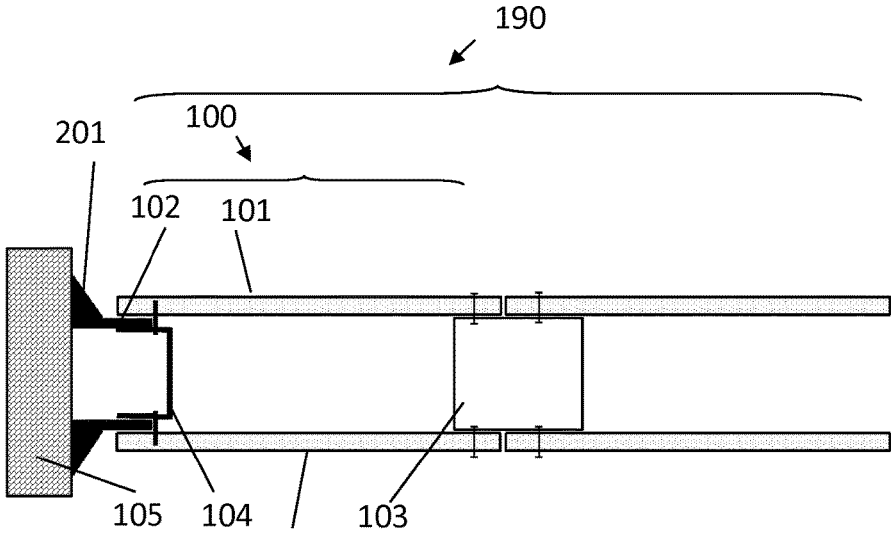
FIG. 14 and FIG. 15 illustrates a schematic top view of a protective structure having an integrated track and wedge in undamaged and damaged state in accordance with embodiments of the current invention.
Figure 15:
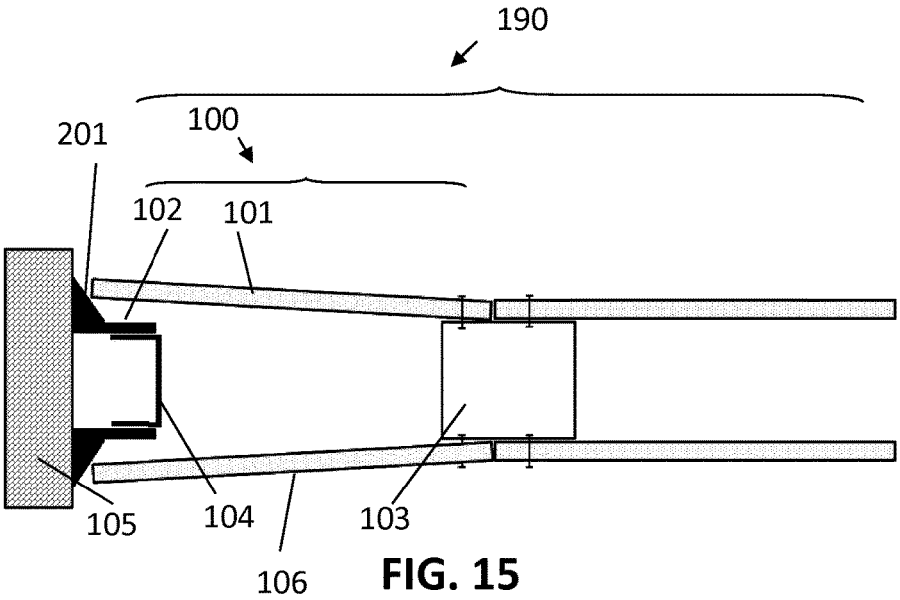

In an embodiment of the present invention, an example being illustrated in FIG. 14, the first stud 102 and the wedge 201 are integrated into one piece. During an earthquake, the gypsum board 101, 106 will move over the wedge 201. In case the earthquake's level is high enough, it will cause the protective board 101, 106 to break. This process is illustrated in FIG. 15. The integration of the 3 different parts has as advantage that mounting of the protective structure becomes easier and less error prone.

Figure 16:
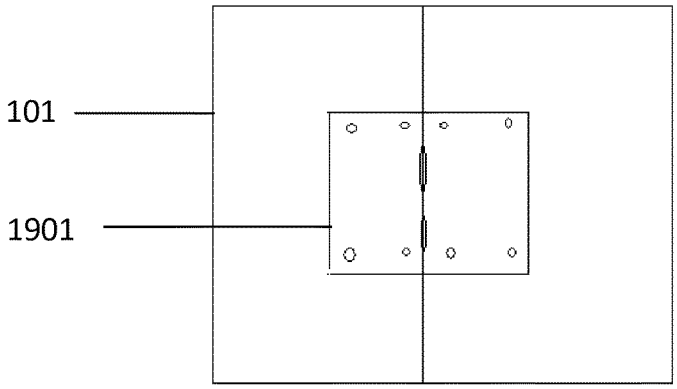
FIG. 16 provides a schematic front view of a protective structure with hinged boards in accordance with embodiments of the current invention.

In an embodiment of the present invention, an example thereof illustrated in FIG. 16, the gypsum board 101 is connected with the second stud 103 such that it can rotate around an axis parallel with the axis of the second stud 103. Therefore a rotating suspension 1901 is foreseen. In embodiments of the current invention the rotating suspension 1901 may comprise an additional board fixed to the protective board 101 and another board fixed to the board on the other side of the second stud 103 to increase the strength of the suspension 109. The extra boards can be used as fixation points for a hinge. The ability of the gypsum board 101 of rotating prevents it from falling down when the connection between the first stud 102 and the gypsum board 101 is broken. When detached from the first stud 102 the gypsum board rotates by means of the rotating suspension 1901. It is an advantage of embodiments of the current invention that the protective board 101, after being disconnected from the first stud 102, does not fall on the ground.

In some embodiments of the present invention the gypsum board 101 is made of the same material as the other gypsum boards, resulting in the advantage that standard available gypsum boards can be used.

In yet other embodiments, the first support element is adapted for, upon a given level of seismic action, inducing a force on the at least one gypsum board. The first support element 102 therefore may be adapted with a stress inducing means that is deformable when a given level of seismic action occurs and that in deformed state provides a pressure on one or more gypsum boards and the one or more gypsum boards are broken.

As indicated, the board may be an edge board but does not need to be. In some embodiments, the system also may be introduced at another position—away from the edge of the partition board—in the partition board for breaking a board at that other position preferentially over the other boards. Except for the change in position, the same principles and features apply.

Figure 17:
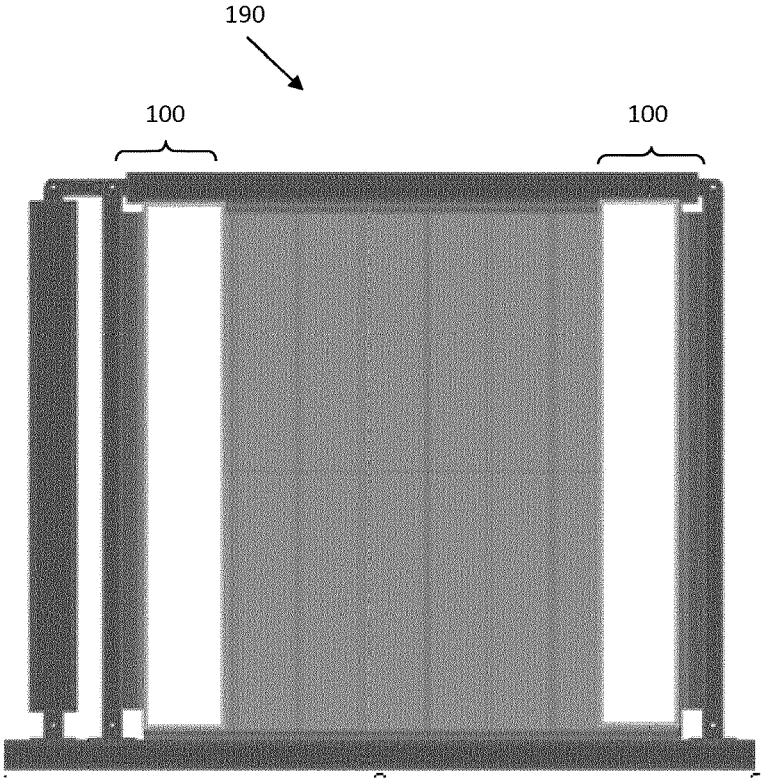
FIG. 17 provides a schematic front view of a board partition wall. The board partition is on both sides protected by a protective structure in accordance with embodiments of the current invention.

In a second aspect, the present invention relates to a board partition comprising a seismic protective structure as described in the first aspect. In advantageous embodiments, the board partition may comprise a seismic protective structure at both ends of the board partition. It is an advantage of embodiments of the current invention that the board partition comprising the protective structure separates two rooms effectively with regard to fire and with regard to acoustics. Since the board partition comprising the protective structure completely separates a place into two places no issue exists with regard to of fire safety and acoustic. By way of illustration, embodiments of the present invention not being limited thereto, an example of a board partition is shown in FIG. 17.

In a third aspect, the present invention relates a kit of parts for constructing or restoring a seismic protective structure as described above. The kit of parts comprises one or more of a track element, a first support element and at least one board. The kit of parts can for example also comprise a stress inducing means for, when mounted in the seismic protective structure, introducing, when a given level of seismic stress is appearing on the board partition (190), additional stress on the at least one board (101) and/or on the first substantially vertical support element (102) for causing the seismic protective structure (100) to damage before the rest of the board partition (190) breaks. Alternatively or in addition thereto, the board may comprise a weaker portion such that, when a given level of seismic stress is appearing on the board partition, the board will break at the weaker portion. The track element or the first support element may comprise the stress inducing means according to an embodiment as described for the first aspect.

In still another aspect, the present invention relates to a method for protecting a board partition against a given level of seismic stress, the method comprising using a seismic protective structure in the board partition such that, when a given level of seismic stress is appearing, damage is intentionally caused to at least one board of the seismic protective structure thereby releasing pressure from the remainder of the board partition. Furthermore also a method for restoring a board partition is disclosed, wherein the method comprises replacing one or more of the board and a first support element for restoring the board partition.

The invention claimed is:

1. A seismic protective structure (100) for forming part of a board partition (190), the seismic protective structure (100) comprising:

at least one board (101), a first support element (102) connected to the at least one board (101) and to an adjacent wall (105) to the board partition (190), a track element (104) connectable to the adjacent wall (105) the track element (104) being positioned for guiding and moveably positioning the first support element (102) therein, at least one wedge (201) shaped and positioned for, upon a given relative movement of the track element (104) and the first support element (102), separating the board (101) from the track element (104), and a second support element (103) linking the at least one board (101) with a remainder of the board partition (190), wherein the board partition (190) is severable from the adjacent wall (105) upon a given level of seismic stress, and releasing stress from the remainder of the board partition (190).

2. A seismic protective structure (100) according to claim 1, wherein the at least one wedge (201) is shaped and positioned for, upon the given relative movement of the track element (104) and the first support element (102), shifting between the first support element (102) and the board (101) for separating the board (101) from the first support element (102).

3. A seismic protective structure according to claim 2, wherein the track element (104) is configured in shape with a protrusion for spacing the board (101) and the first support element (102) with a gap for, upon the given relative movement of the track element (104) and the first support element (102), introducing the wedge (201) between the board (101) and the first support element (102).

4. A seismic protective structure according to claim 1, wherein the first support element (102) comprises a weak portion for breaking of the first support element (102) upon the given level of seismic stress.

5. A seismic protective structure (100) according to claim 4, wherein the first support element (102) comprises two, substantially symmetric sub-elements glued to each other, and the weak portion corresponds with a gluing zone where the sub-elements are glued to each other.

6. A seismic protective structure (100) according to claim 1, wherein the at least one wedge (201), the first support element (102) and the track element (104) are integrated in a single piece.

7. A seismic protective structure (100) according to claim 1, wherein the at least one board (101) comprises a weaker portion such that, upon the given level of seismic stress on the board partition (190), the board (101) will break at the weaker portion.

8. A seismic protective structure (100) according to claim 1, wherein the board (101) is connected through a rotating suspension (1901), with the second support element (103) or a further board of the board partition (190).

9. A seismic protective structure (100) according to claim 1, wherein the board is a gypsum board (101).

10. A seismic protective structure (100) according to claim 1, wherein the first and second support elements (102, 103) are substantially parallel.

11. A seismic protective structure (100) according to claim 10, wherein said first and said second support elements (102, 103) are substantially vertically mounted.

12. A method for restoring the board partition (190) after an earthquake, the board partition (190) comprising a seismic protective structure (100) according to claim 1, the method comprising replacing the at least one board (101) and the first support element (102) for restoring the board partition (190).

13. A seismic protective structure (100) according to claim 1, wherein the at least one wedge (201) is configured to break the first support element (102) into two parts upon the given level of seismic stress.

* * * * *